US010329742B2

(12) United States Patent
Ryu et al.

(10) Patent No.: US 10,329,742 B2
(45) Date of Patent: Jun. 25, 2019

(54) BUCKET TOOTH OF EXCAVATOR

(71) Applicant: SUNGBO INDUSTRIAL CO., LTD., Incheon (KR)

(72) Inventors: Dae Hyun Ryu, Incheon (KR); Chang Woo Lim, Incheon (KR)

(73) Assignee: SUNGBO INDUSTRIAL CO., LTD., Incheon (KR)

( * ) Notice: Subject to any disclaimer, the term of this patent is extended or adjusted under 35 U.S.C. 154(b) by 0 days.

(21) Appl. No.: 15/833,448

(22) Filed: Dec. 6, 2017

(65) Prior Publication Data

US 2019/0048561 A1 Feb. 14, 2019

(30) Foreign Application Priority Data

Aug. 9, 2017 (KR) ..... 10-2017-0100911

(51) Int. Cl.
*E02F 9/28* (2006.01)

(52) U.S. Cl.
CPC ..... *E02F 9/2833* (2013.01); *E02F 9/2825* (2013.01)

(58) Field of Classification Search
CPC ..... E02F 9/2833; E02F 9/2841
See application file for complete search history.

(56) References Cited

U.S. PATENT DOCUMENTS 7,707,755 B2 * 5/2010 Lopez Almendros ..... E02F 9/2825 37/457
8,997,384 B2 * 4/2015 Bartolome Rodriguez ..... E02F 9/2883 37/456
9,033,610 B2 * 5/2015 Lopez Almendros ..... E02F 9/2825 403/355
9,512,599 B2 * 12/2016 Rol Corredor ..... E02F 9/2841
10,106,961 B2 * 10/2018 Rol Corredor ..... E02F 9/2841
2007/0209189 A1 * 9/2007 Lopez Almendros ..... E02F 9/2825 29/525.01
2009/0320333 A1 * 12/2009 Martinez ..... E02F 9/2825 37/450
2010/0115804 A1 * 5/2010 Lopez Almendros ..... E02F 9/2841 37/456
2010/0170119 A1 * 7/2010 Lopez Almendros ..... E02F 9/2825 37/452
2013/0185965 A1 * 7/2013 Bartolome Rodriguez ..... E02F 9/2883 37/453
2014/0223786 A1 * 8/2014 Rol Corredor ..... E02F 9/2841 37/459

(Continued)

FOREIGN PATENT DOCUMENTS

KR 20060011366 2/2006

*Primary Examiner* — Matthew Troutman
(74) *Attorney, Agent, or Firm* — Cantor Colburn LLP

(57) ABSTRACT

Provided is a bucket tooth of an excavator which is capable of raising a fastening force between a tooth adapter and a tooth point, and facilitating assembling and disassembling operations. The bucket tooth of an excavator, includes: a tooth adapter including an adapter body having an insert integrally protruding from a front end thereof and a mounting part formed at a rear end thereof, the mounting part being mounted on a bucket of the excavator; and a tooth point including an excavation part integrally protruding from a front end of a point body and used for excavating a ground surface, the point body having an insert groove into which the insert of the tooth adapter is inserted.

4 Claims, 7 Drawing Sheets

(56) References Cited

U.S. PATENT DOCUMENTS

| | | | | |
|---|---|---|---|---|
| 2015/0275485 | A1* | 10/2015 | Almendros | E02F 9/2825 37/457 |
| 2017/0051475 | A1* | 2/2017 | Perez Soria | E02F 9/2825 |
| 2017/0051476 | A1* | 2/2017 | Rol Corredor | E02F 9/2833 |
| 2017/0067230 | A1* | 3/2017 | Perez Soria | E02F 9/2825 |
| 2017/0175365 | A1* | 6/2017 | Triginer Boixeda | E02F 3/9256 |
| 2017/0328035 | A1* | 11/2017 | Bilal | E02F 9/2833 |
| 2018/0148908 | A1* | 5/2018 | Johnston | E02F 9/2825 |

* cited by examiner

[ 1 : 11, 12, 13 ]
[ 2 : 21, 22 ]
[ 21 : 212, 213, 214, 215 ]
[ 3 : 31, 32, 33, 34 ]
[ 33 : 331, 332, 333 ]

[ 2 : 21, 22 ]

[ 21 : 211, 212, 213, 214, 215 ]

[ 212 : 212a, 212b ]

BUCKET TOOTH OF EXCAVATOR

CROSS-REFERENCE TO RELATED PATENT APPLICATIONS

This application claims the benefit of Korean Patent Application No. 10-2017-0100911, filed on Aug. 9, 2017, in the Korean Intellectual Property Office, the disclosure of which is incorporated herein in its entirety by reference.

BACKGROUND OF THE INVENTION

1. Field of the Invention

The present invention relates to a bucket tooth of an excavator, which has an improved coupling structure between a tooth adapter fixed and coupled to a bucket of an excavator and a tooth point connected to the tooth adapter, and more particularly, to a bucket tooth of an excavator which is capable of raising a fastening force between a tooth adapter and a tooth point, and facilitating assembling and disassembling operations.

2. Description of the Related Art

Patent reference 1 (published on Feb. 3, 2006 and hereafter referred to as 'related art') discloses 'bucket tooth of excavator'.

The related art discloses a bucket tooth of an excavator, including a tooth adapter and a tooth point. The tooth adapter has a mounting part fixed and coupled to a bucket of the excavator through bolting or welding and an insert part protruding from the mounting part so as to be exposed to the outside of the bucket. The tooth point is coupled to the tooth adapter so as to be used for excavation, and has a side-opened insert groove into which the insert part of the tooth adapter is inserted. The tooth adapter has fitting holes formed in the insert part thereof, such that a coupling pin is fitted into the fitting holes, the fitting holes being vertically formed through the top and bottom surfaces of the insert part, respectively. The tooth point has an insertion hole into which the coupling pin is inserted, the insertion hole vertically formed through the top and bottom surfaces of the tooth point while coinciding with the fitting holes of the tooth adapter. The tooth adapter has a locking groove formed at the entrance of one fitting hole thereof, such that a snap ring is inserted into the locking groove, the locking groove communicating with the insertion hole while having a level different from the insertion hole. The coupling pin has a ring groove to which the snap ring inserted into the locking groove of the tooth adapter is elastically fitted and fixed, when the coupling pin is fitted into the fitting holes of the tooth adapter and the insertion hole of the tooth point, which are matched with each other.

The related art has been filed by the present applicant, and the present applicant has developed a bucket tooth of an excavator, which has an improved coupling structure between a tooth adapter and a tooth point, and is capable of raising a fastening force through the coupling structure, and facilitating assembling and disassembling operations.

RELATED ART REFERENCE (Patent Reference 1) Korean Patent Publication No. 10-2006-0011366

SUMMARY OF THE INVENTION

The present invention is to provide a bucket tooth of an excavator, which has an improved coupling structure between a tooth adapter and a tooth point, and is capable of raising a fastening force through the coupling structure and facilitating assembling and disassembling operations.

According to an embodiment of the present invention, a bucket tooth of an excavator, including:

a tooth adapter including an adapter body having an insert integrally protruding from a front end thereof and a mounting part formed at a rear end thereof, the mounting part being mounted on a bucket of the excavator; and a tooth point including an excavation part integrally protruding from a front end of a point body and used for excavating a ground surface, the point body having an insert groove into which the insert of the tooth adapter is inserted, wherein the insert of the tooth adapter and the point body of the tooth point, which are coupled to each other, have a coupling hole and a fitting hole formed therethrough in the side-to-side direction, respectively, such that the coupling hole and the fitting hole coincide with each other during coupling of the tooth adapter with the tooth point, and a fixing pin is inserted into the coupling hole and the fitting hole so as to couple the tooth adapter and the tooth point, the fixing pin has a locking key protruding from one side of an outer circumferential surface thereof, and a surface part formed at the outer circumferential surface thereof around the locking key, the point body has an entrance groove formed at a front side of the fitting hole and communicating with the fitting hole, such that the locking key of the fixing pin is passed through the entrance groove when the fixing pin is inserted into the fitting hole, and the point body has a rotation groove formed at a bottom side of the fitting hole and communicating with the fitting hole, such that the locking key of the fixing pin is locked to or released from the rotation groove while rotating after being passed through the entrance groove.

Preferably, in the bucket tooth according to the embodiment of the invention, the point body has a housing groove formed at a rear side of the fitting hole, the housing groove communicating with the fitting hole and being opened to an inner surface of the insert groove, and a locking rubber for fixing the rotated state of the locking key is inserted into the housing groove.

DETAILED DESCRIPTION OF THE INVENTION

Figure 1:
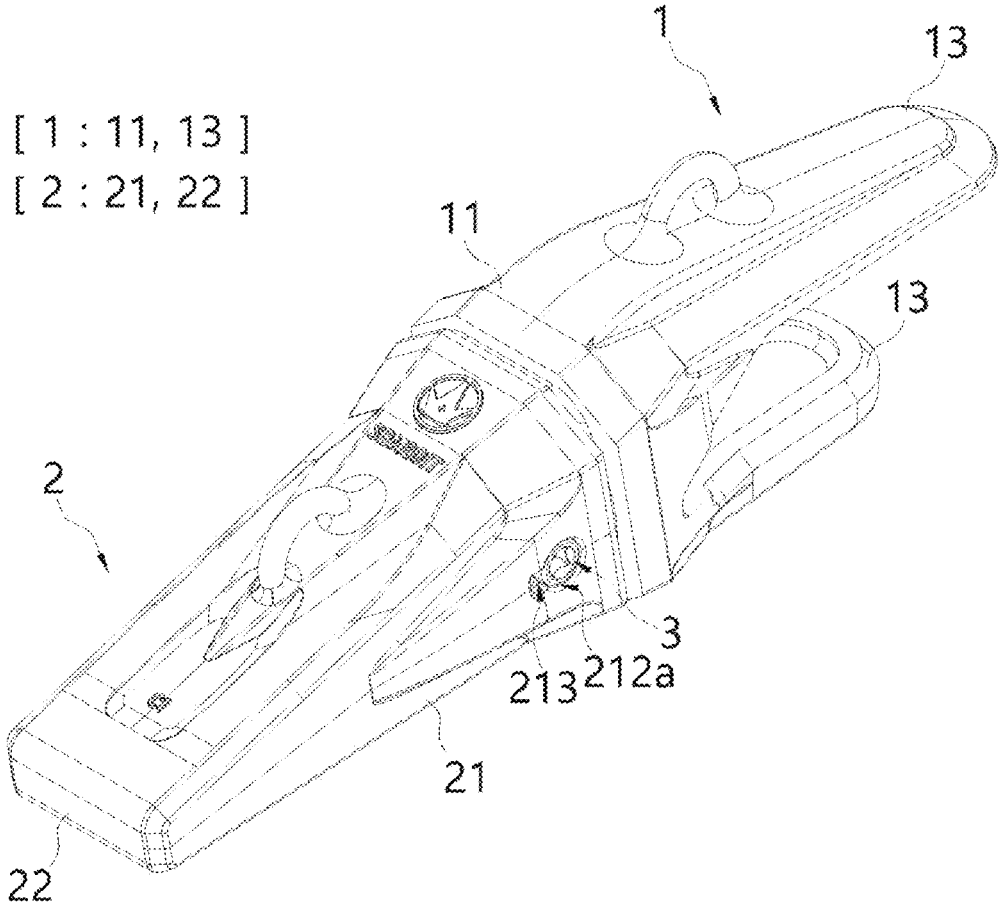
FIG. 1 is an overall configuration view illustrating a bucket tooth of an excavator according to an embodiment of the invention.

Hereinafter, exemplary embodiments of the present invention will be described in detail with reference to the accompanying drawings.

The terms and words used in this specification and claims should not be limited to typical or dictionary meanings, but interpreted as meanings and concepts which coincide with the technical idea of the invention, based on the principle that the present inventor can properly define the concepts of the terms in order to describe the invention in the best way.

Therefore, the embodiments described in this specification and illustrated in the drawings are only preferred embodiments of the invention, and do not fully represent the technical idea of the invention. Thus, various equivalents and modifications capable of replacing the embodiments and configurations may be provided at the point of time that the present application is filed.

Figure 2:
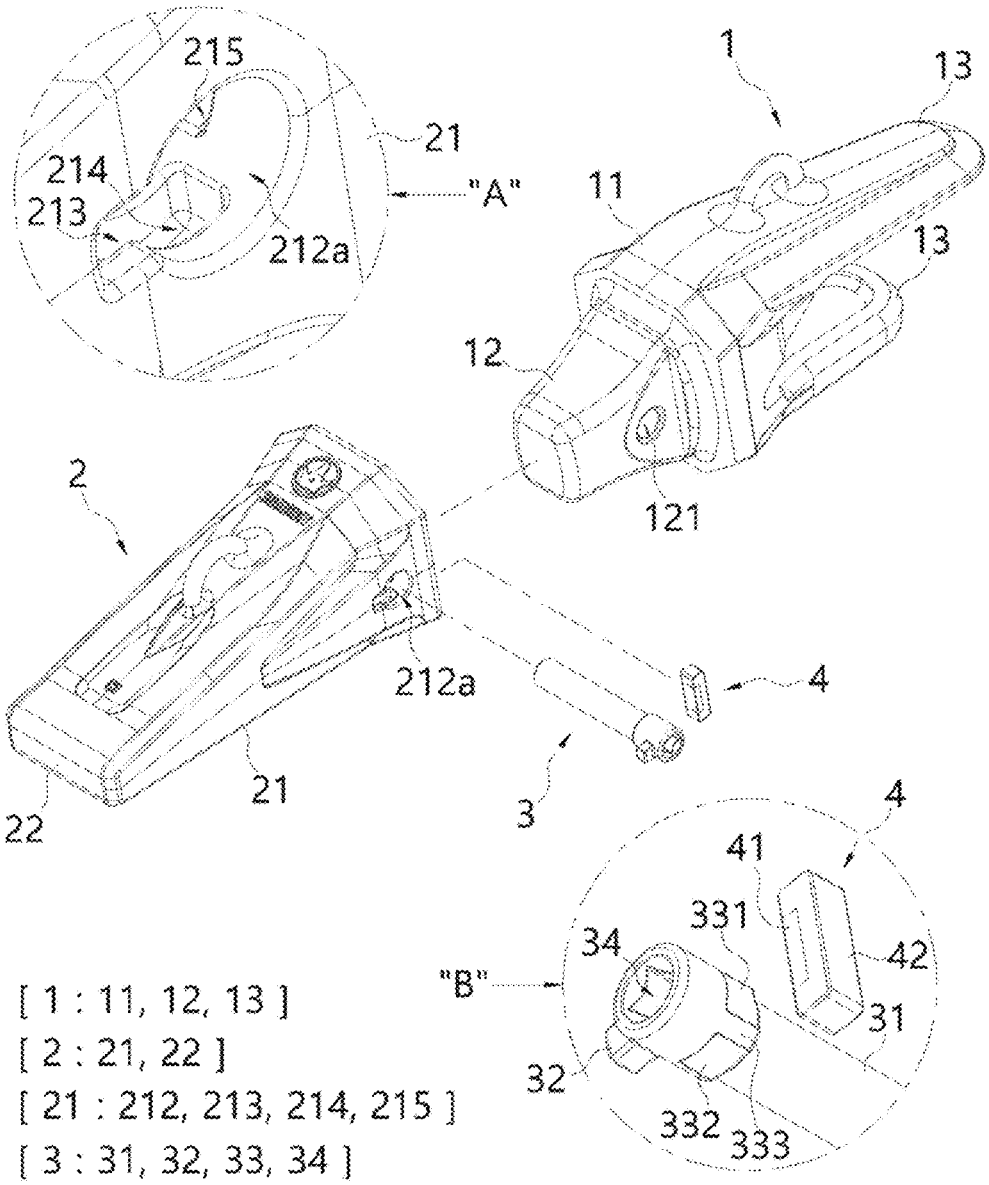
FIG. 2 is an exploded perspective view illustrating the bucket tooth of the excavator according to the embodiment of the invention.

In this specification, the direction of a tooth point 2 is set to the front side, and the direction of a tooth adapter 1 is set to the rear side, based on FIG. 2.

As illustrated in FIGS. 1 and 2, a bucket tooth of an excavator according to an embodiment of the invention includes a tooth adapter 1, a tooth point 2, a fixing pin 3 and a locking rubber 4.

Figure 6:
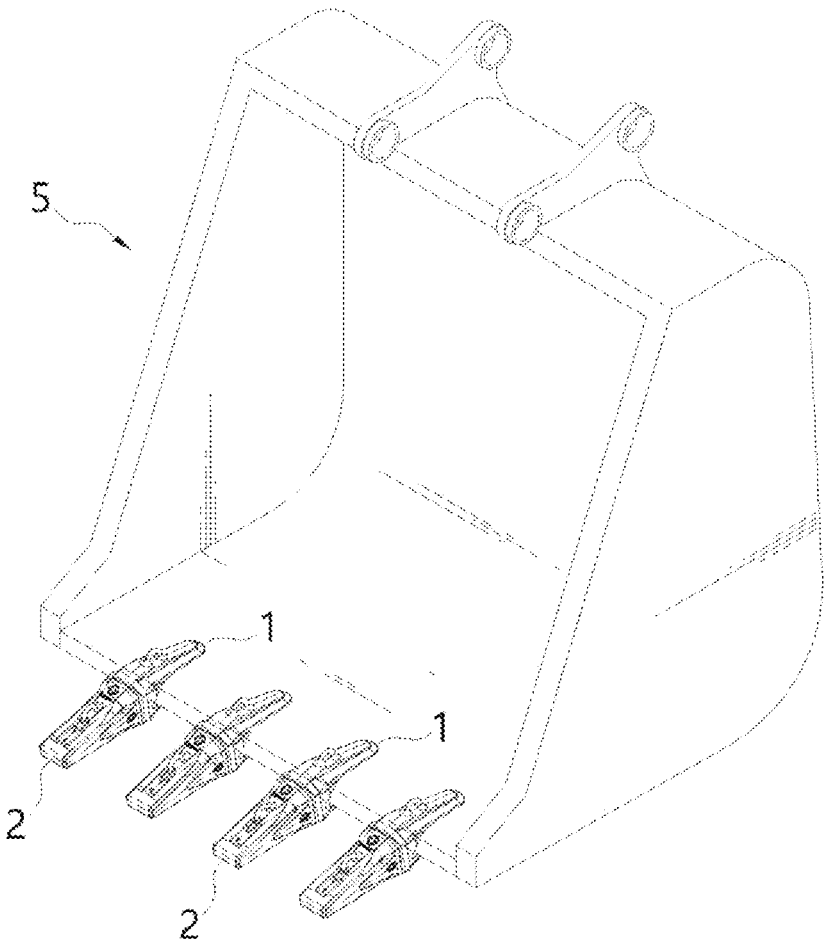
FIG. 6 is a perspective view illustrating that the bucket tooth according to the embodiment of the invention is mounted on a bucket.

The components will be described in detail with reference to FIGS. 1 and 2. The tooth adapter 1 is coupled to a bucket 5 of the excavator (refer to FIG. 6) with the tooth point 2 connected thereto, and then used for excavation. The tooth adapter 1 includes an insert 12 protruding from the front end of an adapter body 11 and a mounting part 13 formed at the rear end of the adapter body 11, the mounting part 13 being mounted on the bucket 5 of the excavator.

The insert 12 has a shape of which the cross-sectional area decreases toward the front side, and the adapter body 11 has a rectangular cross-sectional shape. At this time, the insert 12 has a coupling hole 121 formed at the middle portion thereof, the coupling hole 121 passing through the insert 12 in the side-to-side direction.

The mounting part 13 includes two parts which are connected to the top and bottom of the rear end of the adapter body 11, respectively, extended toward the rear side, and spaced a predetermined distance from each other in the top-to-bottom direction. An end of the bucket 5 of the excavator is inserted between the two parts, and fixed and coupled through bolting or welding (refer to FIG. 6).

Figure 3:
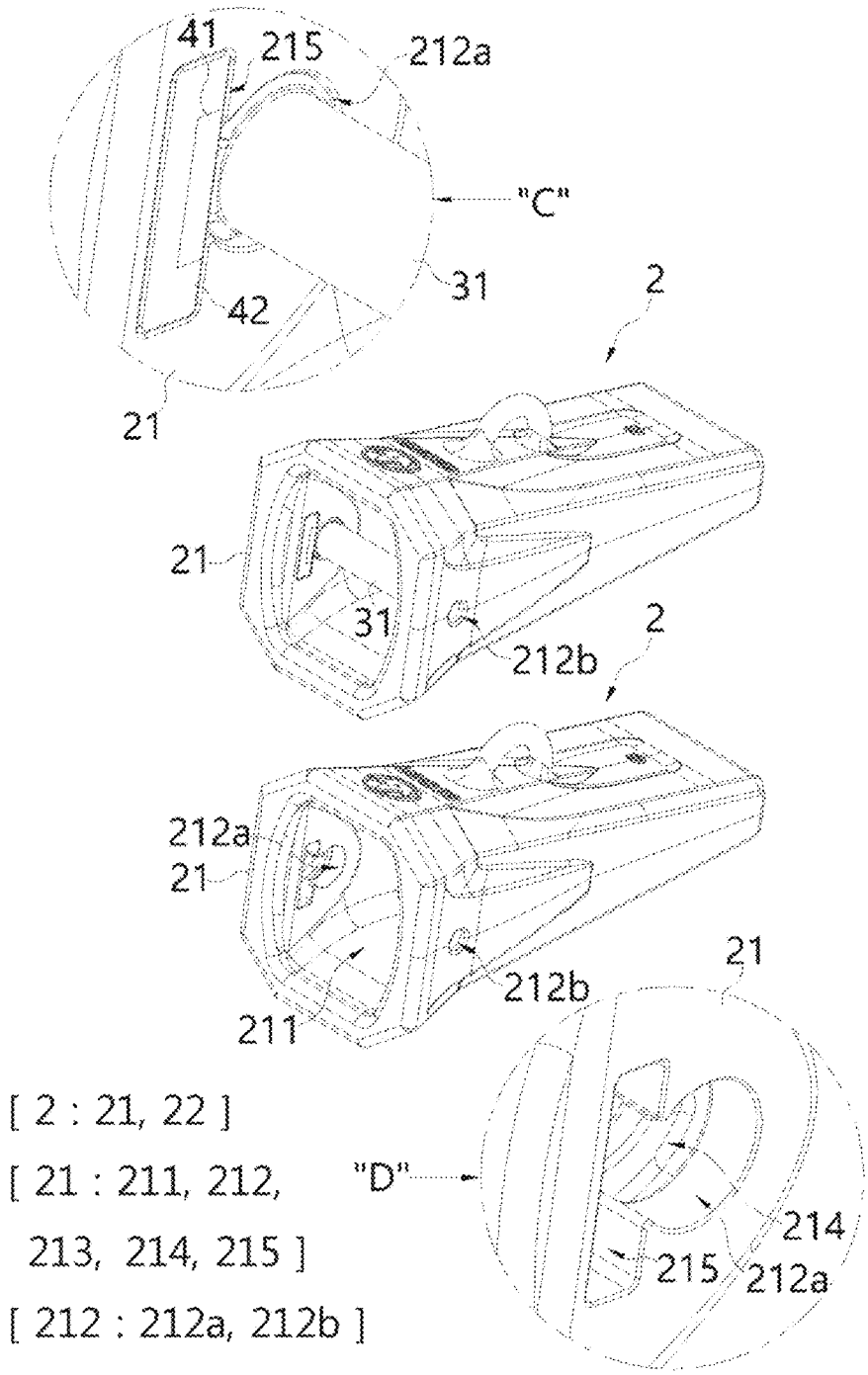
FIG. 3 is a perspective view illustrating a state where a fixing pin and a locking rubber according to the embodiment of the invention are coupled to and separated from a point body.

As illustrated in FIGS. 1 to 3, the tooth point 2 is connected to the tooth adapter 1 and used for excavation. The tooth point 2 includes a point body 21 having an insert groove 211 into which the insert 12 of the tooth adapter 1 is inserted, and an excavation part 22 integrally protruding from the front end of the point body 21 and used for excavating the ground surface. The excavation part 22 has a shape of which the cross-sectional area decreases toward the front side. That is, the excavation part 22 has a sharp shape toward the front side. The insert groove 211 has an internal space corresponding to the insert 12.

The point body 21 has a fitting hole 212 formed therein, and the fitting hole 212 is divided into first and second fitting holes 212*a* and 212*b* connected to the insert groove 211 from the left and right sides of the point body 21, respectively, (refer to FIG. 3). At this time, when the tooth adapter 1 and the tooth point 2 are coupled to each other, the coupling hole 121 of the tooth adapter 1 and the fitting hole 212 of the tooth point 2 are aligned at positions coinciding with each other.

As illustrated in FIGS. 2 to 4B, the fixing pin 3 is inserted into the coupling hole 121 and the fitting hole 212 so as to couple the tooth adapter 1 and the tooth point 2. The fixing pin 3 includes a locking key 32 protruding from one side of the outer circumferential surface of a main body 31 formed in a rod shape, and a surface part 33 formed on the outer circumferential surface of the main body 31 around the locking key 32.

The surface part of the fixing pin 3 includes first and second surface parts 331 and 332 and a stopper part 333 formed between the first and second surface parts 331 and 332, and the first and second surface parts 331 and 332 are formed adjacent to each other while crossing each other at a right angle (refer to a portion B of FIG. 2).

More specifically, as shown in FIG. 2, the first surface part 331 and the second surface part 332 are formed to be perpendicular to each other.

At this time, since the first and second surface parts 331 and 332 cross each other at a right angle, the stopper part 333 is naturally formed between the first and second surface parts 331 and 332.

As illustrated in a portion A of FIG. 2, the point body 21 has an entrance groove 213 formed at the front side of the first fitting hole 212*a* and communicating with the fitting hole 212, such that the locking key 32 of the fixing pin 3 is passed through the entrance groove 213 when the fixing pin 3 is inserted into the first fitting hole 212*a*.

As illustrated in the portion A of FIG. 2 and a portion D of FIG. 3, the point body 21 has a rotation groove 214 formed at the bottom side of the first fitting hole 212*a* and communicating with the first fitting hole 212*a*, such that the locking key 32 of the fixing pin 3, passed through the entrance groove 213, is rotated to be locked to or released from the rotation groove 214.

As illustrated in portions C and D of FIG. 3, the point body 21 has a housing groove 215 formed at the rear side of the first fitting hole 212*a* and communicating with the first fitting hole 212*a*, such that the housing groove 215 is opened to the inner surface of the insert groove 211.

That is, the front side of the housing groove 215 communicates with the first fitting hole 212*a*, and the right side of the housing groove 215 communicates with the insert groove 211.

The fixing pin 3 has a wrench fitting groove 34 formed at one side thereof.

Figure 4A:
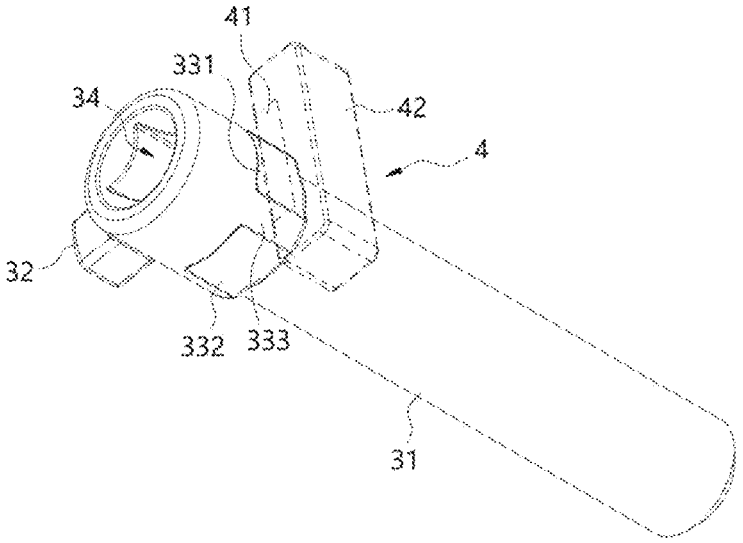
FIGS. 4A and 4B are conceptual views illustrating a state where the fixing pin and the locking rubber according to the embodiment of the invention are used.
Figure 4B:
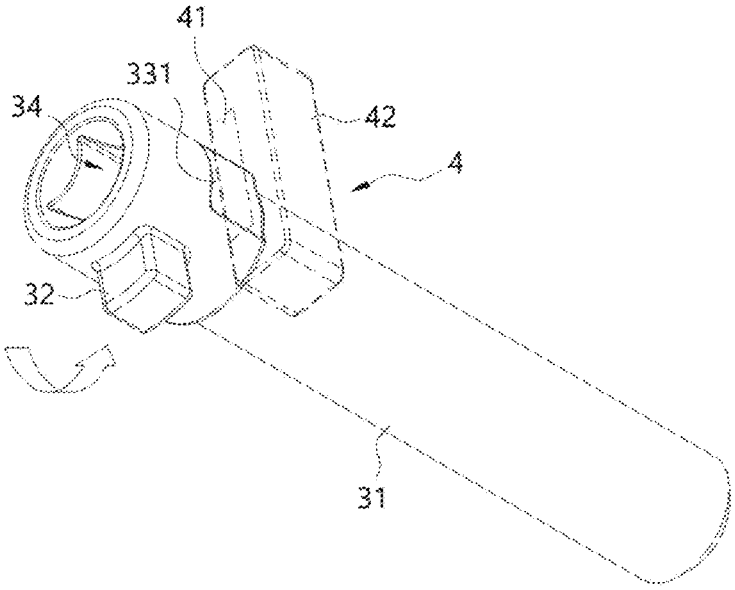

As illustrated in FIG. 2 and FIGS. 4A and 4B, the locking rubber 4 is fitted and fixed to the housing groove 215, in order to fix the rotated locking key 32 (the portion C of FIG. 3).

At this time, the locking rubber 4 includes a body part 41 formed at the front end thereof and corresponding to the surface part 33 of the fixing pin 3; and a rubber part 42 being in contact with the rear end of the body part 41. The rubber part 42 is inserted into the housing groove 215, and elastically deformed when the body part 41 presses the rubber part 42. Therefore, the rubber part 42 is formed of a material having an elastic force, such as rubber and a synthetic resin.

When the stopper part 333 of the fixing pin 3 presses the body part 41 of the locking rubber 4, the body part 41 is moved to the rear side while pressing the rubber part 42. When the pressing is removed, the body part 41 is returned to the original state by the elastic force of the rubber part 42.

Therefore, direct friction between the body part 41 and the stopper part 333 formed of a metallic material can be reduced, which makes it possible to prevent mutual abrasion between the stopper part 333 and the body part 41.

The operation of the bucket tooth of the excavator according to the embodiment of the invention is performed as follows. First, with the locking rubber 4 inserted and fixed to the housing groove 215, the fixing pin 3 is inserted into the second fitting hole 212*b* of the tooth point 2 through the coupling hole 121 of the tooth adapter 1 via the first fitting hole 212*a* of the tooth point 2.

That is, the other side of the fixing pin 3 is fitted to the second fitting hole 212*b*, and one side of the fixing pin 3 is fitted to the first fitting hole 212*a*.

Figure 5A:
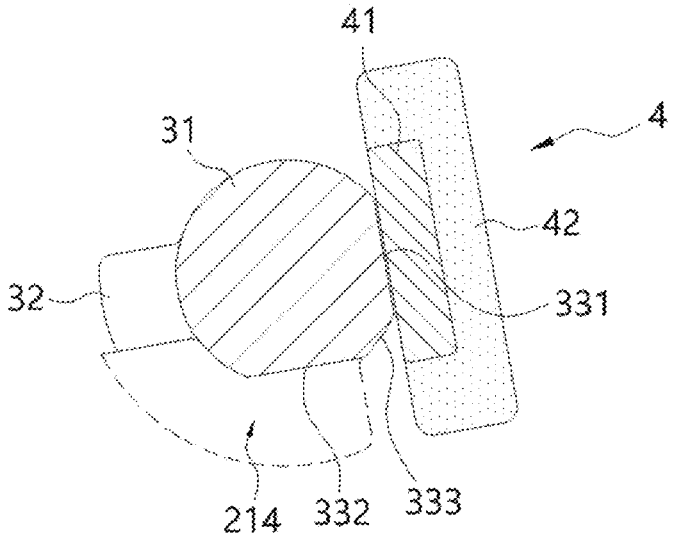
FIGS. 5A to 5C are side cross-sectional views illustrating the state where the fixing pin and the locking rubber according to the embodiment of the invention are used.

At this time, as illustrated in FIG. 5A, the locking key 32 formed on the fixing pin 3 is passed through the entrance groove 213 and positioned above the rotation groove 214. The first surface part 331 of the fixing pin 3 is brought in contact with the body part 41 of the locking rubber 4 inserted and fixed to the housing groove 215, while facing the body part 41 of the locking rubber 4.

Figure 5B:
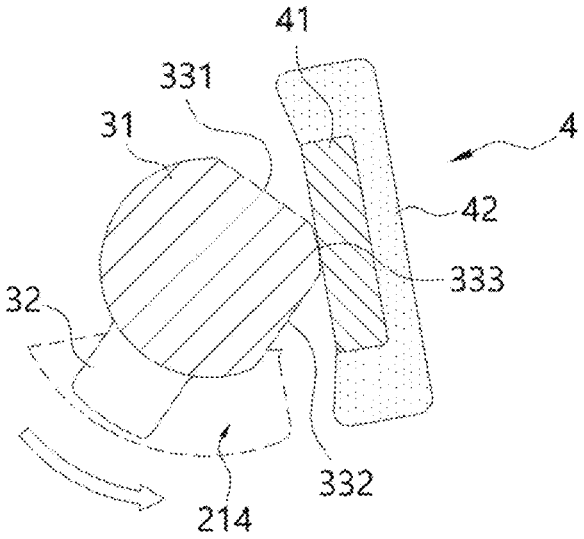

In this state, a user fits a wrench into the wrench fitting groove 34 of the fixing pin 3, and then rotates the wrench in the counterclockwise direction as illustrated in FIGS. 4B and 5B. Then, the fixing pin 3 is rotated in the counterclockwise direction, and the surface part 33 and the locking key 32 of the fixing pin 3 are also rotated in the counterclockwise direction at the same time.

Therefore, the stopper part 333 formed between the first and second surface parts 331 and 332 is rotated upward in the counterclockwise direction while the first surface part 331 is rotated. At this time, the radius of rotation of the stopper part 333 causes the stopper part 333 to rotate while gradually pressing the body part 41 of the locking rubber 4 (FIG. 5B).

Then, the body part 41 is moved to the rear while pressing the rubber part 42, due to the elastic force of the rubber part 42.

At this time, when the stopper part 333 is positioned at the middle portion of the body part 41 of the locking rubber 4, the pressure of the stopper part 333 for the locking rubber 4 is maximized. Then, as the stopper part 333 faces upward past the middle portion of the body part 41 of the locking rubber 4, the pressure decreases.

Figure 5C:
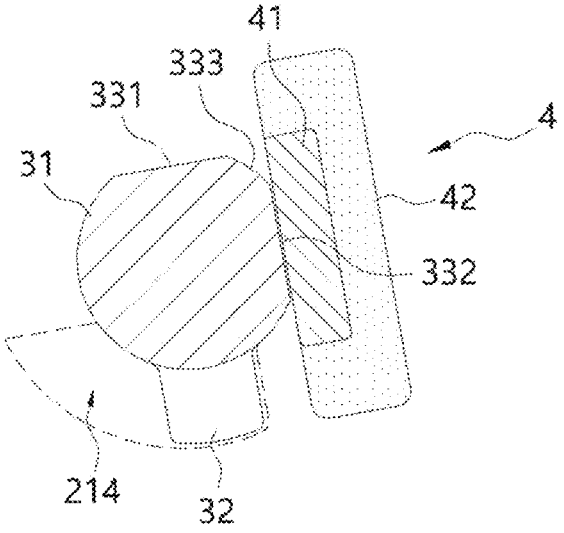

Then, when the stopper part 333 is continuously rotated until the stopper part 333 is separated from the body part 41 past the body part 41 of the locking rubber 4, the pressure of the stopper part 333 for the body part 41 of the locking rubber 4 is removed. Simultaneously, the body part 41 is returned to the original state, and the second surface part 332 of the fixing pin 3 is brought in contact with the body part 41 of the locking rubber 4, while facing the body part 41 of the locking rubber 4 (FIG. 5C).

When the fixing pin 3 is rotated, the locking key 32 formed on the fixing pin 3 is rotated downward at the same time, and disposed in the rotation groove 214 of the tooth point 2 (refer to FIG. 5B).

That is, when the stopper part 333 of the fixing pin 3 is rotated while pressing the body part 41 of the locking rubber 4, the locking key 32 is rotated to enter the rotation groove 214 formed in the tooth point 2 at the same time.

Then, when the pressure of the stopper part 333 for the locking rubber 4 is removed, the locking key 32 is positioned at the rear end of the rotation groove 214. Simultaneously, the rotation of the locking key 32 is stopped at the rear end of the rotation groove 214.

At this time, as described above, the second surface part 332 of the fixing pin 3 is brought in contact with the body part 41 of the locking rubber 4 while facing the body part 41 of the locking rubber 4. Thus, as long as the user does not rotate the fixing pin 3 in the clockwise direction, the fixing pin 3 is not rotated, and the locking key 32 of the fixing pin 3 is locked to the wall surface of the rear end of the rotation groove 214, thereby preventing the fixing pin 3 from separating from the fitting hole 212 and the coupling hole 121.

Therefore, the locking key 32 of the fixing pin 3 is locked to the rotation groove 214 of the tooth point 2 through the above-described process, such that the tooth adapter 1 and the tooth point 2 are reliably fixed and coupled to each other.

The coupling between the tooth adapter 1 and the tooth point 2 is released as follows. The fixing pin 3 is rotated in the clockwise direction such that the first surface part 331 of the fixing pin 3 is brought in contact with the body part 41 of the locking rubber 4 while facing the body part 41 of the locking rubber 4. Then, the fixing pin 3 is separated from the fitting hole 212 and the coupling hole 121.

That is, the tooth adapter 1 and the tooth point 2 may be separated according to the reverse sequence of the method for coupling the tooth adapter 1 and the tooth point 2.

So far, the bucket tooth of the excavator, which has a specific shape and structure, has been described with reference to the accompanying drawings. However, the present invention can be modified and changed in various manners by those skilled in the art, and the modification and changes may belong to the scope of the invention.

According to the embodiment of the present invention, the bucket tooth of the excavator can raise a fastening force through the improved coupling structure between the tooth adapter and the tooth point, and facilitate the assembling and disassembling operations.

What is claimed is:

1. A bucket tooth of an excavator, comprising:

a tooth adapter including an adapter body having an insert integrally protruding from a front end thereof and a mounting part formed at a rear end thereof, the mounting part being mounted on a bucket of the excavator; and a tooth point including an excavation part integrally protruding from a front end of a point body and used for excavating a ground surface, the point body having an insert groove into which the insert of the tooth adapter is inserted, wherein the insert of the tooth adapter and the point body of the tooth point, which are coupled to each other, have a coupling hole and a fitting hole formed therethrough in the side-to-side direction, respectively, such that the coupling hole and the fitting hole coincide with each other during coupling of the tooth adapter with the tooth point, and a fixing pin is inserted into the coupling hole and the fitting hole so as to couple the tooth adapter and the tooth point, the fixing pin has a locking key protruding from one side of an outer circumferential surface thereof, and a surface part formed at the outer circumferential surface thereof around the locking key, the point body has an entrance groove formed at a front side of the fitting hole and communicating with the fitting hole, such that the locking key of the fixing pin is passed through the entrance groove when the fixing pin is inserted into the fitting hole, and the point body has a rotation groove formed at a bottom side of the fitting hole and communicating with the fitting hole, such that the locking key of the fixing pin is locked to or released from the rotation groove while rotating after being passed through the entrance groove, wherein the point body has a housing groove formed at a rear side of the fitting hole, the housing groove communicating with the fitting hole and being opened to an inner surface of the insert groove, and a locking rubber for fixing the rotated state of the locking key is inserted into the housing groove.

2. The bucket tooth of claim 1, wherein the locking rubber includes:

a body part formed at a front end of the locking rubber so as to correspond to the surface part of the fixing pin; and a rubber part being in contact with a rear end of the body part, inserted into the housing groove, and elastically deformed when the body part is pressed.

3. The bucket tooth of claim 1, wherein the surface part of the fixing pin includes first and second surface parts and a stopper part formed between the first and second surface parts, and the first and second surface parts are perpendicular to each other.

4. The bucket tooth of claim 1, wherein the fixing pin has a wrench fitting groove formed at one side thereof.

* * * * *